US007591470B2

(12) United States Patent
Belinkoff

(10) Patent No.: US 7,591,470 B2
(45) Date of Patent: Sep. 22, 2009

(54) MODIFIED BLACKJACK GAME

(75) Inventor: Kevin Belinkoff, Santa Monica, CA (US)

(73) Assignee: Game Show Network, LLC, Santa Monica, CA (US)

( * ) Notice: Subject to any disclaimer, the term of this patent is extended or adjusted under 35 U.S.C. 154(b) by 67 days.

(21) Appl. No.: 11/711,160

(22) Filed: Feb. 27, 2007

(65) Prior Publication Data

US 2007/0235937 A1 Oct. 11, 2007

Related U.S. Application Data

(60) Provisional application No. 60/776,794, filed on Feb. 27, 2006.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,423,551 A * 6/1995 Stavinsky ..... 273/306
2007/0090599 A1* 4/2007 Hamilton ..... 273/292
2007/0135951 A1* 6/2007 Romik et al. ..... 700/91

* cited by examiner

*Primary Examiner*—Gene Kim
*Assistant Examiner*—Amir Klayman
(74) *Attorney, Agent, or Firm*—Katten Muchin Rosenman LLP

(57) ABSTRACT

A method for playing a modified version of blackjack is provided. The modified blackjack game involves a competition between several players, each of whom plays conventional blackjack against the "house". The objective is to win the most money from wagering. The cards are dealt from a shoe, and at least one "knockout" card is also included in the shoe. When the knockout card is dealt, the player having the lowest money total after the next hand is eliminated from the competition. A tournament may be conducted by enabling the winners and second-place finishers from a succession of competitions to proceed to the next round of the tournament, and to continue until a single overall tournament winner is determined. One or more "lucky losers" may also be allowed to proceed into the next round based on a random selection, despite not having been a winner or a second-place finisher in the previous round.

2 Claims, 2 Drawing Sheets

MODIFIED BLACKJACK GAME

This application claims priority under 35 U.S.C. § 119(e) to U.S. Provisional Application No. 60/776,794, filed on Feb. 27, 2006, the entire contents of which are hereby incorporated by reference herein.

BACKGROUND OF THE INVENTION

1. Field of the Invention

The present invention relates generally to a modified version of the blackjack card game.

2. Related Art

Blackjack, also known as Twenty-One, is a card game that has been played for many decades by recreational players and gamblers. Blackjack is a mainstay at casinos all over the United States and the world.

Generally, at casinos, blackjack is played according to a set of standardized rules. These standardized rules include rules regarding the play of the cards and rules regarding how the players may place wagers.

A genre of television programs known as "game shows" has been in existence for decades. On a typical game show, contestants compete against one another for a reward, such as a prize or money. The competition typically involves the playing of a game. The actual competition is recorded and then later broadcast as a television program. In some instances, the game is based on a conventional game that might be expected to be well-known by members of a television audience. However, the game rules may be adapted due to the constraints of a television program, such as, for example, a time constraint. In addition, the game rules may also be adapted in a manner calculated to make the game and the competition more exciting for the television viewers, because a major objective of the production of a television program is to attract as many viewers to watch the program as possible.

In recent years, games and sporting events have become increasingly popular for spectator purposes, whether in live attendance or via television. Because of the proliferation of television networks and the economic success associated with broadcasting such contests, a need has arisen to adapt the conventional game of blackjack so that it is suitable for television, with respect to both its ability to be shown as a program over a fixed time interval and its entertainment value. The present invention addresses these considerations.

SUMMARY OF INVENTION

In one aspect, the invention provides a method for conducting a blackjack competition among a plurality of players. The competition involves the use of a shoe having a predetermined number of standard decks of cards and at least one additional knockout card. Each of the plurality of players has a total amount of money. The method includes the steps of: a) accepting an initial wager from each player for a first hand; b) dealing two cards to each player, the two cards being at least a portion of the respective player's hand; c) dealing two cards to a dealer, the two cards being at least a portion of the dealer hand, wherein one of the two dealer cards is face-up and a second of the two dealer cards is face-down; d) enabling each player to successively play his respective hand according to the conventional rules of blackjack; e) after each player has played his own hand, revealing the face-down card from the dealer hand and then completing the dealer hand according to the conventional rules of blackjack; f) based on results of steps d and e for each respective player, determining whether each player has won, lost, or tied, and then either collecting or paying out an appropriate amount of money based on each respective determination and based on each respective wager; g) accepting an initial wager from each respective player for a next hand; h) repeating each of steps b, c, d, e, and f for the next hand; and i) repeating each of steps g and h until all cards in the shoe have been dealt. When the at least one knockout card is dealt to any player or to the dealer, the knockout card is revealed to all players, the current hand is completed, a next hand is played to completion, and a player then having the lowest total amount of money is eliminated from the blackjack competition. When a last knockout card is dealt, the method further includes the steps of: reshuffling all of the cards originally included in the shoe; playing five more hands as shown above in steps a, b, c, d, e, and f; and determining a winner and a second-place finisher based on the players' respective total amounts of money.

In another aspect, a method of conducting a blackjack tournament is provided. The tournament includes a plurality of blackjack competitions according to the above description. The method includes the steps of: a) selecting all winner and all second-place-finishers from the plurality of blackjack competitions; b) randomly selecting at least one additional player from at least one of the plurality of blackjack competitions; and c) conducting an additional blackjack competition as described above. The plurality of players includes players selected in one of step a and step b.

DETAILED DESCRIPTION OF THE INVENTION

Figure 1:
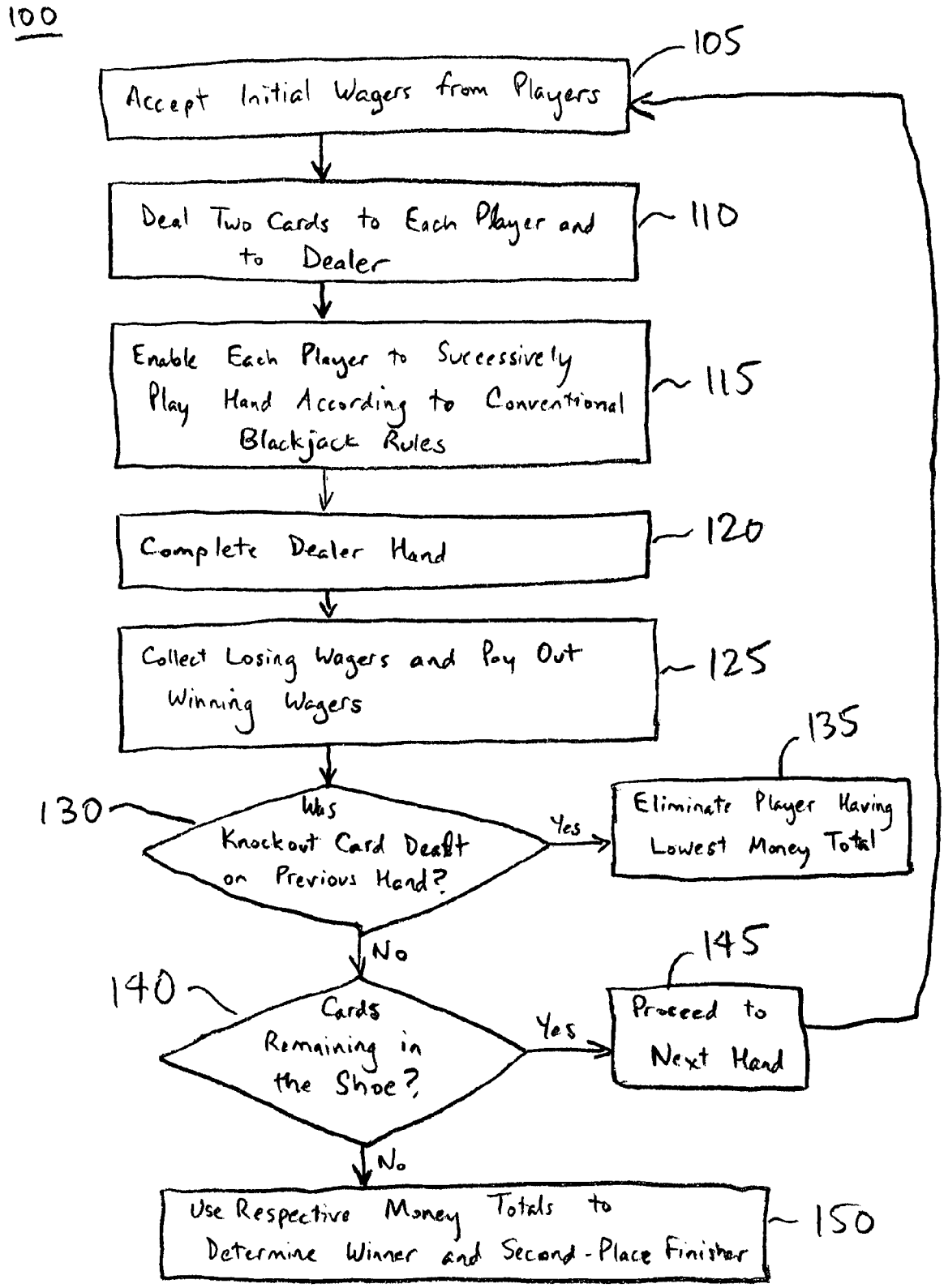
FIG. 1 is a flow chart of a method of playing a modified version of blackjack, according to a preferred embodiment of the invention.

The present invention is directed to a modified version of blackjack which is intended for competitive play among a plurality of players. Referring to FIG. 1, a flow chart 100 provides an illustration of a modified method of blackjack according to a preferred embodiment of the invention. Each player is provided with an equal "stake", or total amount of money, to be used for wagering. A single "game", or competition, includes a plurality of hands of cards, which are dealt from a shoe. The shoe includes a predetermined number of decks of standard playing cards.

In addition, at least one special card, hereinafter referred to as a "knockout" card, is also placed into the shoe. In a preferred embodiment, a competition includes five players, and two knockout cards are placed into the shoe.

To begin the competition, at step 105, each player places an initial wager. The amounts of the wagers may be restricted; for example, each wager may be required to be at least some predetermined minimum and to be at most some predetermined maximum. Also, the amounts of the wagers may be required to be multiples of a predetermined increment.

Then, at step 110, two cards are dealt to each player and two cards are dealt to the dealer. One of the dealer's cards is dealt face-down so that the other players will not know the value of the face-down card; the other of the dealer's cards is dealt face-up so that all players know the value of that card. Both of each player's cards are dealt face-up.

At step 115, each player plays his respective hand according to the conventional casino rules of blackjack. In particular, players are allowed to split pairs, double down, purchase insurance in certain circumstances, and surrender in certain circumstances. Details of these rules may be found in the appendix attached to this specification.

At step 120, the dealer hand is completed. First, the face-down dealer card is revealed to the players. Then, based on the total point value of the dealer's hand, the dealer either stands or takes additional cards. If the dealer's hand is 17 or greater, the dealer must stand, i.e., not take any additional cards. If the dealer's hand is 16 or less, the dealer must take an additional card. After taking an additional card, if the dealer's hand is 22 or greater, the dealer busts and the hand is over. If the dealer's hand is between 17 and 21, the dealer must hold. If the dealer's hand remains 16 or less, the dealer must take another additional card. This process continues until the dealer either stands or busts.

At step 125, each player hand is compared with the dealer hand, and a determination is made as to whether the player wins, loses, or ties. If the player wins, a payout to the player equal to the amount of the wager is made. If the player loses, the player forfeits the amount of the wager. If the player ties, the player's wager is returned to the player, but no additional payout is made.

When a knockout card is dealt to any player or to the dealer, this fact is revealed to all of the players. The knockout card is then thrown out and replaced with a regular card from the shoe. However, the fact that the knockout card has been dealt is a signal to all of the players that after the current hand and the next hand have been completed, the player having the lowest total amount of money on hand at that point in time will be eliminated, as shown in steps 130 and 135.

At steps 140 and 145, after each hand, play continues with another hand until all of the cards in the shoe have been depleted. Once the last hand has been played, at step 150, a winner and a second-place finisher are determined on the basis of money totals owned by each player. Alternatively, instead of depleting the cards in the shoe, when a last knockout card is dealt, step 145 may be replaced by the following steps: reshuffling all of the cards originally included in the shoe; playing a predetermined number of additional hands (e.g., five more hands) as shown above in steps a, b, c, d, e, and f; and determining a winner and a second-place finisher based on the players' respective total amounts of money.

Figure 2:
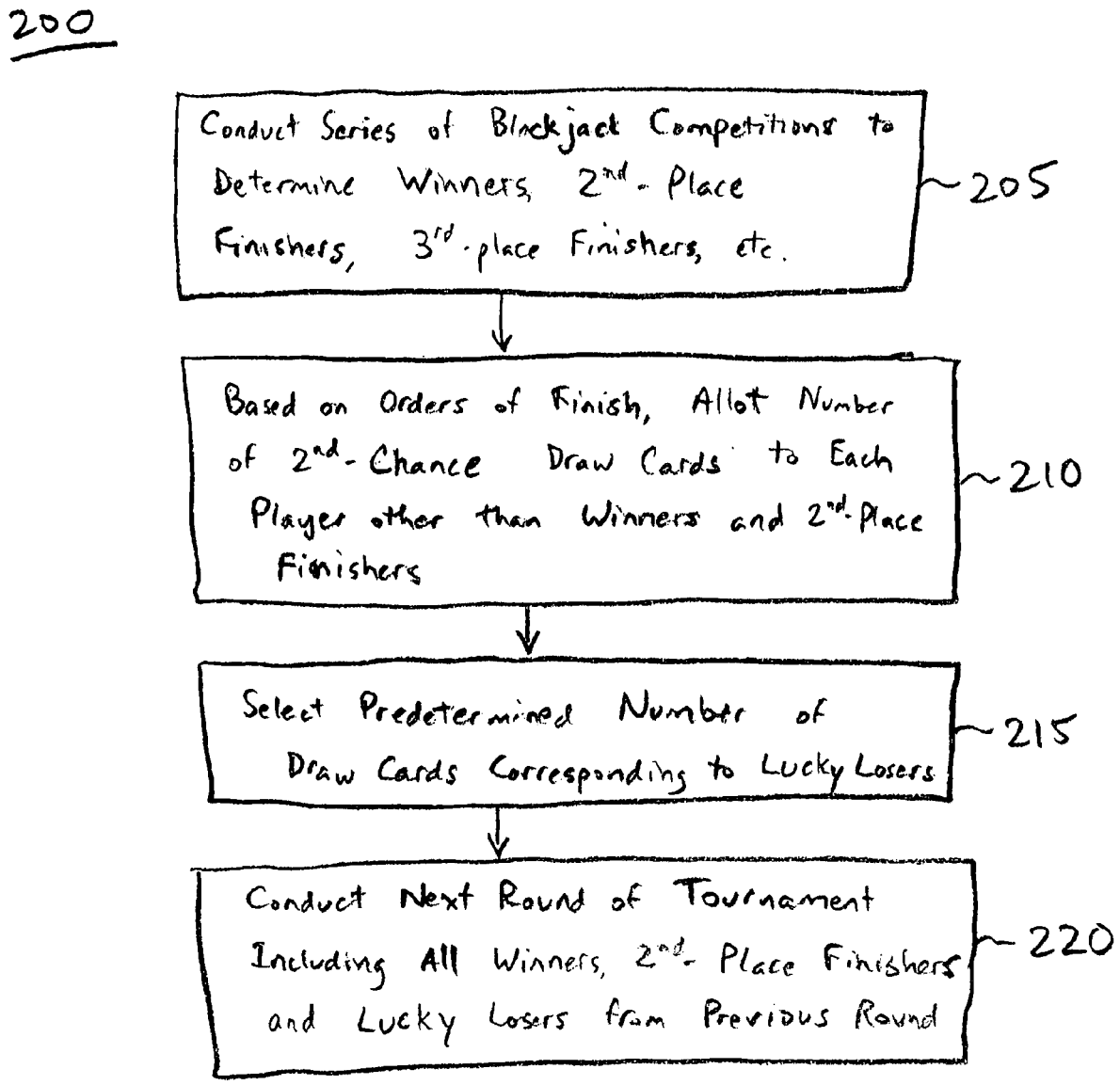
FIG. 2 is a flow chart of a method of conducting a multi-game blackjack tournament, according to a preferred embodiment of the invention.

Referring to FIG. 2, a multi-game tournament may be conducted. At step 205, a first round of games, as illustrated in FIG. 1, are played, and a set of winners and second-place finishers is determined.

At step 210, all players not finishing as a winner or a second-place finisher are allotted a predetermined number of draw cards, based on their respective orders of finish. For example, if each game included five players, then each third-place finisher may be allotted three draw cards, and each fourth-place finisher may be allotted two draw cards, and each fifth-place finisher may be allotted one draw card. Then, at step 215, all of the draw cards are placed into a single pool, and at least one "lucky loser" is drawn from the pool at random.

At step 220, the next round of the tournament is conducted by playing another set of blackjack competitions, including all winners, second-place finishers, and lucky losers from the previous round. Successive rounds are played until there is a single winner of the entire tournament.

In a preferred embodiment, the modified blackjack game of the present invention may also include a special chip, hereinafter referred to as a power chip. Each player is allotted a predetermined number of power chips for each game; for example, each player may be allotted one power chip for the game. The player may use the power chip to discard and replace a card from his hand, at any point in time chosen by the player. In this manner, the player may choose to use a power chip strategically when the player deems it advantageous to improve the odds of winning a given hand, particularly if the player has placed a relatively high wager amount on that hand.

The modified blackjack game of the present invention is suitable for being broadcast for audience viewing, for example, via television or the Internet. Such a blackjack game may be televised either as a live action game, or as a previously recorded event. The broadcast of the game may include announcers, such as sportscasters, and reporters that conduct interviews of the players before, during, and after the actual play of the game(s). The blackjack game may be played in front of a live audience to add to the excitement of the broadcast. Each game may be part of a tournament schedule. The broadcast may include advertising, such as commercial announcements by sponsor organizations. The advertising may provide funding to support the cost of producing the broadcast.

An appendix to this specification is attached. The appendix includes a set of detailed rules for playing a modified blackjack game and conducting a blackjack tournament according to a preferred embodiment of the invention.

While the present invention has been described with respect to what is presently considered to be the preferred embodiment, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for conducting a blackjack competition among a plurality of players using a shoe having a predetermined number of standard decks of cards and at least one additional knockout card, each of the plurality of players having a total amount of money, and the method comprising the steps of:

a) accepting an initial wager from each player for a first hand;

b) dealing two cards to each player, the two cards being at least a portion of the respective player's hand;

c) dealing two cards to a dealer, the two cards being at least a portion of the dealer hand, wherein one of the two dealer cards is face-up and a second of the two dealer cards is face-down;

d) enabling each player to successively play his respective hand according to the conventional rules of blackjack;

e) after each player has played his own hand, revealing the face-down card from the dealer hand and then completing the dealer hand according to the conventional rules of blackjack;

f) based on results of steps d and e for each respective player, determining whether each player has won, lost, or tied, and then either collecting or paying out an appropriate amount of money based on each respective determination and based on each respective wager;

g) accepting an initial wager from each respective player for a next hand;

h) repeating each of steps b, c, d, e, and f for the next hand; and i) repeating each of steps g and h until all cards in the shoe have been dealt, wherein, when the at least one knockout card is dealt to any player or to the dealer, the knockout card is revealed to all players, the current hand is completed, a next hand is played to completion, and a player then having a least total amount of money is eliminated from the blackjack competition; and wherein, when a last knockout card is dealt, the method further includes the steps of:

reshuffling all of the cards originally included in the shoe;

playing five more hands as shown above in steps a, b, c, d, e, and f; and determining a winner and a second-place finisher based on the players' respective total amounts of money.

2. A method of conducting a blackjack tournament, the tournament including a plurality of blackjack competitions according to claim 1, and the method including the steps of:

a) selecting all winner and all second-place-finishers from the plurality of blackjack competitions;

b) randomly selecting at least one additional player from at least one of the plurality of blackjack competitions; and c) conducting an additional blackjack competition according to claim 1, wherein the plurality of players includes players selected in one of step a and step b.

* * * * *